United States Patent [19]

Cole et al.

[11] 3,993,456

[45] Nov. 23, 1976

[54] PROCESS FOR DESULFURIZING PIPELINED COAL

[75] Inventors: Edward L. Cole, Fishkill; Matthew A. McMahon, Wappingers Falls, both of N.Y.

[73] Assignee: Texaco Inc., New York, N.Y.

[22] Filed: Feb. 24, 1975

[21] Appl. No.: 552,395

[52] U.S. Cl. ..... 44/1 R; 44/51

[51] Int. Cl.[2] ..... C10L 9/10; C10L 1/32

[58] Field of Search ..... 44/1 R, 1 G, 51; 201/17

[56] References Cited

UNITED STATES PATENTS

| | | | |
|---|---|---|---|
| 2,346,151 | 4/1944 | Burk et al. | 44/1 R |
| 2,359,325 | 10/1944 | McConnell et al. | 44/1 R |
| 3,768,988 | 10/1973 | Meyers | 44/1 R |

*Primary Examiner*—Carl F. Dees

*Attorney, Agent, or Firm*—T. H. Whaley; C. G. Ries; Robert Knox, Jr.

[57] ABSTRACT

Disclosed is a process for reducing the pyritic content of coal while a coal-water slurry is transported in a pipeline by injecting a pyrite oxidant into the pipeline upstream of the dewatering plant associated therewith.

6 Claims, 1 Drawing Figure

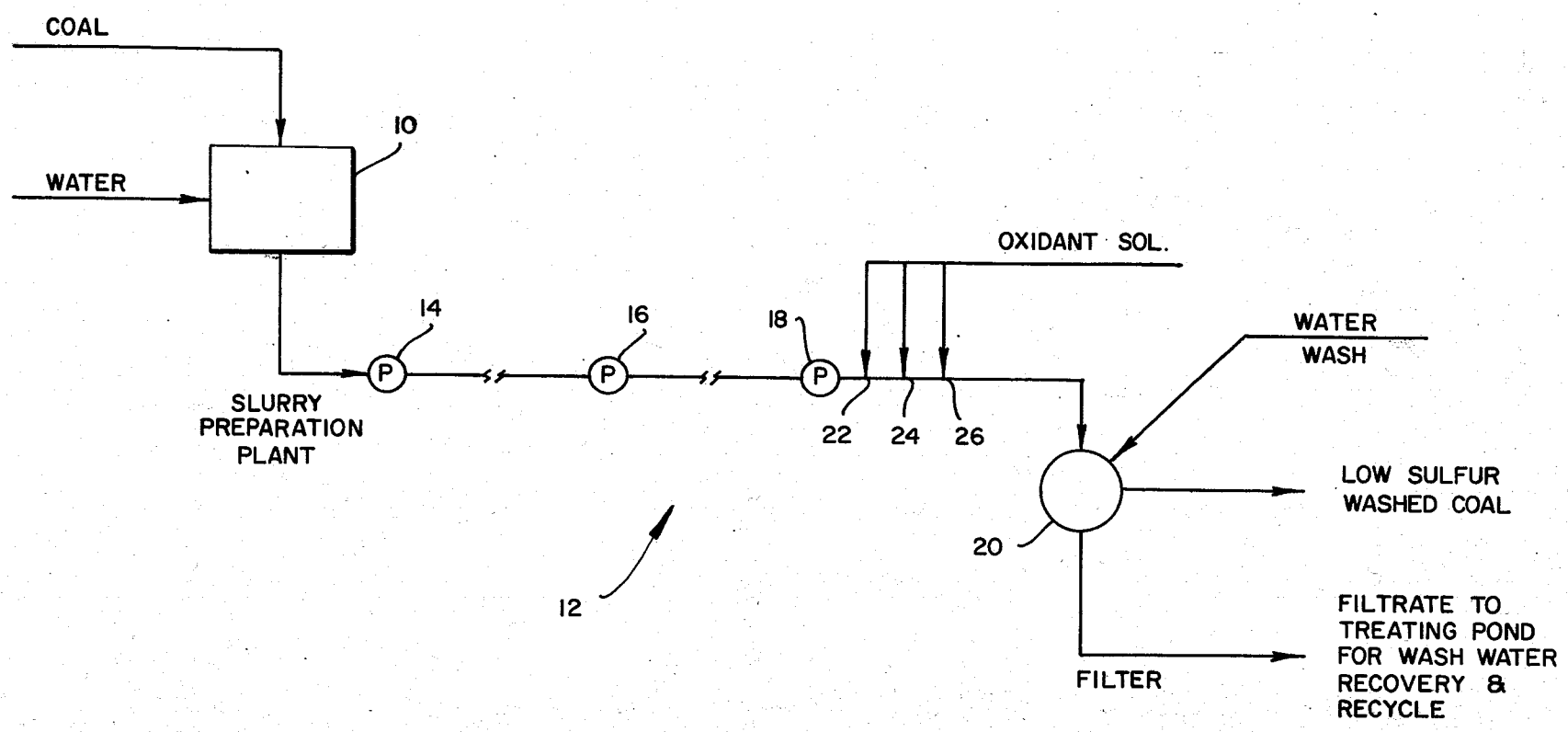
COAL
WATER
10
SLURRY PREPARATION PLANT
14
P
16
P
18
P
OXIDANT SOL.
22
24
26
WATER WASH
20
LOW SULFUR WASHED COAL
FILTER
FILTRATE TO TREATING POND FOR WASH WATER RECOVERY & RECYCLE
12

PROCESS FOR DESULFURIZING PIPELINED COAL

BACKGROUND OF THE INVENTION

Field of the Invention

This invention relates to a leaching process for reducing the pyritic sulfur content of coal while the same is being transported in a pipeline in the form of a water slurry. The process preferably is conducted at a temperature of 70° to 100° F at ambient pressure with a concentration of oxidant ranging from 1 to 1.5 times the stoichiometric amount of sulfur estimated present in the coal and with a turbulance ranging from a Reynolds Number of about 2000 to about 3000.

Coals are not burned at the mine-site except in rare instances and as a consequence, the coal must be transported to the point of use. This is done with unit and integral trains, slurry pipelines, trucking and barging on inland waterways. The economics that govern the selection of the transportation mode depend on a variety of factors such as the availability of railroad lines, a waterway, and the distance the coal must be transported.

Coals to be transported may require a pre-treatment or clean-up to remove inert materials as mineral matter and water. More recently, regulations established by the Environmental Protection Agency have set a limit for new stationary plants of 1.2 pounds of $SO_2$ emissions that may be discharged to the atmosphere per million Btu heat input. As a consequence of this act, the majority of the coals in the United States are removed from the fuel slate of the country unless the sulfur in the coal is reduced.

Sulfur is found in coal in three forms. These are referred to as pyritic sulfur, organic sulfur, and sulfate sulfur. Treating the coal in the presence of hydrogen and hydrogen rich solvents, hydrogen donors, at elevated temperatures and pressures can effectively be used to give a carbonaceous product having a sulfur concentration low enough to meet Federal Specifications. However, the method is expensive and may be a more severe treatment that the coal may require. Thus by merely removing one of the sulfur components of the coal many of the coals can then be burned within the EPA emission limits. This is an approach now under consideration, that is removal or reduction or pyritic type sulfur, ferrous disulfite ($FeS_2$). $FeS_2$ occurs in two crystalline forms, one known as pyrite and the other as marcasite. The former is the most common in the United States although mixtures of the two may occur. There are two general methods for removing pyritic sulfur from coal, one relies on the difference in the physical characteristics of the coal and iron pyrite while the other depends on the chemical conversion of the iron pyrite to a water soluble species. Physical separation of the iron pyrite and the coal may be made as the result of gravity difference between the iron pyrite and coal. The former has specific gravities from 4.89 to 5.03 while the range of specific gravities for coal is 1.2 to 1.8. Thus, separations may be made by the use of heavy liquid (dense medium processes) wherein the coal is floated from the pyrite, hydraulic separation by the use of jigs where a particle stratification is achieved as the result of pulsating fluid flow in a bed of particles or by the use of wet concentrating tables, e.g., Diester table, and by flotation that depends on the selective adhesion to air of some solids and the simultaneous adhesion to water of other solids.

Iron pyrite may be selectively oxidized to soluble sulfates, according to the following reactions:

$$FeS + 4.6\ Fe_2(SO_4) + 4.8\ H_2O \xrightarrow{50\ -120^\circ\ C} 10.2\ FeSO_4 + 4.8\ H_2SO_4 + 0.8S$$

$$FeS_2 + 7/2\ O_2 + H_2O \rightarrow FeSO_4 + H_2SO_4$$

$$FeS_2 + H_2O_2 \rightarrow FeSO_4 + H_2SO_4 + H_2O$$

and, etc.

ANALYSIS OF THE PRIOR ART

In a paper presented at the America Mining Congress Coal Convention, in May 1974, the authors, J. C. Agarwal et al described a process wherein pyritic sulfur present in a coal slurry is oxidized only to soluble sulfates at 60°–130° C under a pressure of 100–300 psig for 2–16 hours depending on the oxidant used. The slurry is separated and the coal fraction is washed with water. The washed coal from which the pyritic sulfur has thus been removed is then slurry-pipelined to a power plant or dried.

SUMMARY OF THE INVENTION

The present process eliminates the cost of expensive leaching and mixing tanks used by the prior art process above described and is conducted in the pipeline normally used to transport the coal.

The present process is particularly applicable to:

1. Those coals having a total sulfur content such that when the pyritic sulfur is removed by the subject process, the coal will then meet the EPA limits for $SO_2$ emissions when burned. It is estimated that about 10 percent of the present coal reserves in the United States have low enough organic and sulfate sulfur content such that with pyrite removal, present emission laws can be met and:

2. Those coals being pipelined.

The process is further illustrated by a single FIGURE showing schematically the steps involved. The diagram shows a coal-water slurry preparation plant 10 and a pipeline system 12 together with pumps for moving the slurry. The process involves the injection of the oxidant solution into the pipeline upstream of the dewatering plant 20. The injection of the oxidant can be made at a single point 22 or at multiple points 24–26 along the pipeline; the only requirement being that sufficient time be allowed to permit utilization of the oxidant by the pyrite. However, advantageously the point or points of injection are made as closely as possible to the dewatering plant due to the corrosive nature of oxidation products. Optionally, the section of the pipeline where oxidation is conducted may be a corrosion resistant steel or have a corrosion resistant lining.

It is important to reduce the total contact time and for this several courses are available. One is to raise the temperature, from 70° to 100° F.; increase the concentration of oxidant solution, from 1 to 1 stoichiometric to 1.5 times the stoichiometric requirements; increase the mixing by increasing the turbulence in the pipeline, increasing the Reynolds No. from $< 2000$ to $> 2000$ particularly above 3000. A combination of the enumerated variables will be best for particular slurry densities.

The invention is further illustrated by the following example:

EXAMPLE I.

A pipeline system as shown in the FIGURE is being used to transmit 570 tons per hour of coal as a slurry comprising 53 percent dry coal and 47 percent water.

The size of the coal comprising the slurry is as follows:

| U.S. Standard Sieve | Weight, % |
|---|---|
| +20 | 12.5 |
| −20 +325 | 67.3 |
| −325 | 20.2 |
| The analysis of the coal is as follows: | |
| 8020 Btu/lb. (as received) | |
| 0.48% Sulfur (organic) | |
| 0.17% Sulfur (pyritic) | |
| 0.05% Sulfur (sulfate) | |
| 0.70% Sulfur, total | |

The slurry is pumped at a rate of 4 miles/hour for a total distance of 52 miles. The ambient temperature averages 82° F. and the temperature of the slurry is about 80° F. The slurry is treated with a 20 percent stoichiometric excess of hydrogen peroxide as a 10 percent water solution.

The peroxide solution is injected into the pipeline in two equal portions. The first feed point is six miles removed from the dewatering plant while the second point of injection is about 5.5 miles from the dewatering plant. As the result of adding the oxidant the temperature in the pipeline rose to somewhat over 100° F. The coal is recovered at the dewatering plant. Analytical tests on the coal are listed as follows:

| | |
|---|---|
| 7950 Btu/lb. | (as recovered) |
| 0.39% Sulfur | (organic) |
| 0.03% Sulfur | (pyrite) |
| 0.05% Sulfur, | (sulfate) |

The $SO_2$ emissions for the coal have been reduced to an acceptable level as the result of this treatment. The comparative data are as follows:[1]

| | Charge Coal | Product Coal |
|---|---|---|
| Lbs. $SO_2/10^6$ Btu | 1.75 | 1.18 |

[1]Federal Standards read: "1.2 lbs. of $SO_2$ per million Btu heat input, —, when solid fuel is burned."

Suitable oxidants in water solution for the present process in addition to hydrogen peroxide include:

Ferric chloride
Nitric acid
Ferric sulfate
Oxygen, air
Sodium hypochlorite and organic peracids including peracetic acid, sodium persulfate and the like.

A latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. A process for reducing the pyritic sulfur content of coal as it is being transported in a pipeline as a coal-water slurry from a slurry preparation plant to a dewatering plant which comprises injecting said slurry in at least one point upstream of said dewatering plant with a pyrite oxidant solution at a temperature of between about 70° and 100° F. under turbulent flow conditions characterized by a Reynolds Number of about 2000 to about 3000.

2. The process of claim 1 wherein said oxidant has a concentration of from 1 to about 1.5 the stoichiometric amount of pyritic sulfur in said coal.

3. The process of claim 1 wherein said oxidant is hydrogen peroxide, ferric chloride, nitric acid, ferric sulfate, an oxygen-containing gas, sodium hypochlorite or an organic per acid.

4. The process of claim 1 wherein said oxidant is an organic peracid.

5. The process of claim 1 in which the oxidant is an oxygen-containing gas.

6. The process of claim 1 in which the oxidant is sodium hypochlorite.

* * * * *